US008545120B2

(12) United States Patent
Breidenbach et al.

(10) Patent No.: US 8,545,120 B2
(45) Date of Patent: Oct. 1, 2013

(54) DUAL COSMETIC CONTAINER

(76) Inventors: Diane C. Breidenbach, Smithtown, NY (US); Laurence W. Mille, Smithtown, NY (US)

( * ) Notice: Subject to any disclaimer, the term of this patent is extended or adjusted under 35 U.S.C. 154(b) by 0 days.

(21) Appl. No.: 13/547,298

(22) Filed: Jul. 12, 2012

(65) Prior Publication Data

US 2013/0004226 A1 Jan. 3, 2013

Related U.S. Application Data

(63) Continuation of application No. 09/842,371, filed on Apr. 25, 2001, which is a continuation-in-part of application No. 09/515,956, filed on Feb. 29, 2000, now Pat. No. 6,488,427.

(51) Int. Cl.
*B05C 1/00* (2006.01)

(52) U.S. Cl.
USPC ..... 401/17; 401/35; 401/34

(58) Field of Classification Search
USPC ..... 401/16–18, 34; 132/294, 314
See application file for complete search history.

(56) References Cited

U.S. PATENT DOCUMENTS

| | | | | |
|---|---|---|---|---|
| 400,491 | A | | 4/1889 | Ross |
| 1,670,458 | A | * | 5/1928 | Le Boeuf ..... 401/214 |
| 1,928,998 | A | | 10/1933 | Kovacs |
| 2,110,237 | A | | 2/1938 | Parsons |
| 2,264,482 | A | | 12/1941 | Ridner |
| D139,495 | S | | 11/1944 | Bennett |
| 2,464,278 | A | | 3/1949 | Wilson |
| D161,036 | S | | 10/1949 | Norriss |
| D156,018 | S | | 11/1949 | Lewis |
| 2,562,496 | A | | 7/1951 | Kirsch |
| D164,327 | S | | 8/1951 | Roehrich |
| 2,577,577 | A | | 12/1951 | Groh |
| 2,663,891 | A | | 12/1953 | Hanryon |
| 2,763,882 | A | | 9/1956 | Planka |
| 2,902,041 | A | * | 9/1959 | Bau ..... 132/318 |
| 3,156,272 | A | | 11/1964 | Indrunas |
| 3,335,854 | A | | 8/1967 | Landen |
| 3,341,884 | A | * | 9/1967 | Pryor ..... 401/17 |
| 3,578,223 | A | | 5/1971 | Armour |
| 3,592,202 | A | | 7/1971 | Jones |
| 3,690,777 | A | | 9/1972 | Costa |
| 3,696,919 | A | | 10/1972 | Miles |
| 3,726,446 | A | | 4/1973 | Hays |
| 3,733,179 | A | | 5/1973 | Guehler |
| 3,747,773 | A | | 7/1973 | Jackson |
| 3,825,021 | A | | 7/1974 | Seidler |

(Continued)

OTHER PUBLICATIONS

Revlon, one page advertisement, Glamour Magazine, May 1998, The Conde Nast Publications Inc., New York NY 10017.

(Continued)

*Primary Examiner* — David Walczak
*Assistant Examiner* — Jennifer C Chiang
(74) *Attorney, Agent, or Firm* — Thomas A. O'Rourke; Bodner & O'Rourke, LLP

(57) ABSTRACT

A dual cosmetic container is disclosed. The container has a sleeve that has a first end and a second end, each of the ends are adapted to receive a receptacle for containing a cosmetic product. The cosmetic product in the first receptacle is different from the cosmetic product in the second receptacle. At least one of the receptacles has an applicator in the form of a rollerball for dispensing product.

14 Claims, 6 Drawing Sheets

(56) References Cited

U.S. PATENT DOCUMENTS

| | | | |
|---|---|---|---|
| 3,846,518 | A | 11/1974 | McPhee |
| 3,856,138 | A | 12/1974 | Maekawa |
| 3,897,004 | A | 7/1975 | French |
| D241,120 | S | 8/1976 | Dekker |
| 4,133,445 | A | 1/1979 | Mandelbaum |
| 4,170,082 | A | 10/1979 | Freedman |
| 4,174,035 | A | 11/1979 | Wiegner |
| 4,196,808 | A | 4/1980 | Pardo |
| 4,203,534 | A | 5/1980 | Finke |
| D260,559 | S | 9/1981 | Scalice |
| 4,300,681 | A | 11/1981 | Klygis |
| D262,606 | S | 1/1982 | Kaufmann |
| 4,336,882 | A | 6/1982 | Sakwa |
| 4,340,157 | A | 7/1982 | Darner |
| 4,377,234 | A | 3/1983 | Kaplan |
| 4,444,324 | A | 4/1984 | Grenell |
| 4,530,439 | A | 7/1985 | Finnell |
| 4,533,052 | A | 8/1985 | Fruchey et al. |
| 4,533,068 | A | 8/1985 | Meierhoefer |
| 4,542,930 | A | 9/1985 | Adams |
| 4,562,685 | A | 1/1986 | Tomita et al. |
| 4,614,267 | A | 9/1986 | Larkin |
| D287,168 | S | 12/1986 | Kingsford |
| 4,643,426 | A | 2/1987 | Adams |
| 4,667,839 | A | 5/1987 | Crisci |
| 4,690,276 | A | 9/1987 | Sussman |
| 4,690,673 | A | 9/1987 | Bloomquist |
| D294,804 | S | 3/1988 | Lunderman |
| 4,782,670 | A | 11/1988 | Long et al. |
| 4,801,052 | A | 1/1989 | Citterio |
| 4,840,908 | A | 6/1989 | Burns |
| 4,872,774 | A | 10/1989 | Rosso |
| 4,993,860 | A | 2/1991 | Sommer |
| 5,061,103 | A | 10/1991 | Walsh-Smith |
| D322,391 | S | 12/1991 | Morane |
| D322,750 | S | 12/1991 | Sommer |
| D325,342 | S | 4/1992 | Balavich |
| 5,104,008 | A | 4/1992 | Crisci |
| 5,110,014 | A | 5/1992 | Doundoulakis |
| 5,141,136 | A | 8/1992 | Tignor |
| 5,158,191 | A | 10/1992 | Douglas |
| 5,174,460 | A | 12/1992 | Minnette |
| D333,014 | S | 2/1993 | Lang |
| 5,273,083 | A | 12/1993 | Burrows |
| D343,699 | S | 1/1994 | Yang |
| D344,017 | S | 2/1994 | Lang |
| D345,915 | S | 4/1994 | Fareri |
| 5,310,094 | A | 5/1994 | Martinez et al. |
| 5,314,067 | A | 5/1994 | Strock |
| 5,316,159 | A | 5/1994 | Douglas |
| 5,338,123 | A | 8/1994 | Obersteller et al. |
| 5,341,691 | A | 8/1994 | Callis et al. |
| 5,373,940 | A | 12/1994 | Hilleson |
| 5,373,972 | A | 12/1994 | Boystrom et al. |
| 5,413,152 | A | 5/1995 | Burrows |
| 5,456,294 | A | 10/1995 | Tsao et al. |
| 5,464,110 | A | 11/1995 | Heyworth |
| 5,469,980 | A | 11/1995 | O'Meara |
| D368,427 | S | 4/1996 | Bicknell |
| 5,505,325 | A | 4/1996 | Thompson et al. |
| 5,509,742 | A | 4/1996 | Balzarini |
| D370,088 | S | 5/1996 | Burns |
| 5,525,299 | A | 6/1996 | Lowe |
| 5,526,960 | A | 6/1996 | Breidenbach |
| 5,531,057 | A | 7/1996 | Coleman et al. |
| 5,542,581 | A | 8/1996 | Habora et al. |
| 5,543,097 | A | 8/1996 | Fang |
| 5,586,694 | A | 12/1996 | Breidenbach |
| 5,588,562 | A | 12/1996 | Sander et al. |
| 5,590,780 | A | 1/1997 | O'Meara |
| 5,607,860 | A | 3/1997 | Gombrich et al. |
| 5,652,143 | A | 7/1997 | Gombrich et al. |
| 5,653,270 | A | 8/1997 | Burrows |
| 5,655,554 | A | 8/1997 | Goldberg |
| D385,184 | S | 10/1997 | Binter |
| D390,117 | S | 2/1998 | Kan |
| D391,166 | S | 2/1998 | Lang |
| 5,738,067 | A | 4/1998 | Landwehr |
| 5,778,902 | A | 7/1998 | Nagy |
| 5,794,819 | A | 8/1998 | Smith |
| 5,799,838 | A | 9/1998 | Miller |
| 5,803,268 | A | 9/1998 | Levy |
| 5,810,495 | A | 9/1998 | McAuley |
| 5,813,529 | A | 9/1998 | Goserud |
| 5,833,654 | A | 11/1998 | Powers |
| 5,862,490 | A | 1/1999 | Sasuta et al. |
| 5,862,949 | A | 1/1999 | Markey |
| 5,881,742 | A | 3/1999 | Hunsberger |
| 5,884,678 | A | 3/1999 | Chudy |
| D408,592 | S | 4/1999 | Litton |
| 5,897,262 | A | 4/1999 | Bratby-Carey |
| 5,897,265 | A | 4/1999 | Wilson |
| 5,927,884 | A | 7/1999 | Kao |
| 5,937,864 | A | 8/1999 | Diaz |
| 5,937,866 | A | 8/1999 | Magharehi |
| D422,748 | S | 4/2000 | Lang |
| D425,412 | S | 5/2000 | Breidenbach |
| D436,225 | S | 1/2001 | Garofano |
| 6,200,045 | B1 * | 3/2001 | Hahn et al. ..... 401/18 |
| 6,241,408 | B1 * | 6/2001 | Lang ..... 401/17 |
| 6,276,853 | B1 | 8/2001 | Breidenbach et al. |
| 6,276,856 | B1 | 8/2001 | Pieper et al. |
| 6,305,861 | B1 | 10/2001 | Gueret |
| 6,450,179 | B2 * | 9/2002 | Bengis ..... 132/297 |
| 6,488,427 | B1 | 12/2002 | Breidenbach et al. |
| 6,612,764 | B2 | 9/2003 | Dumler |
| 6,682,242 | B1 | 1/2004 | Montoli |

OTHER PUBLICATIONS

Carolina Herrera, "212" fragrance bottle, one page advertisement and Applicant's sketch of the interior of the Carolina Herrera dispenser. 1998.

* cited by examiner 32
30
31
13
11
12
22

32
30
31
22

22
33

DUAL COSMETIC CONTAINER

The present application is a continuation of U.S. application Ser. No. 09/842,371, filed Apr. 25, 2001, which is a continuation-in-part of U.S. application Ser. No. 09/515,956, filed Feb. 29, 2000 now U.S. Pat. No. 6,488,427, the disclosures of which are incorporated herein by reference.

FIELD OF THE INVENTION

This invention relates to the field of cosmetic packaging, in particular cosmetic packaging that is attractive and at the same time provides multiple cosmetic products in a form that conserves space particularly in a women's purse, pocket book or other carrying device.

BACKGROUND OF THE INVENTION

Cosmetics is a major industry today with a myriad of different products. Many consumers use a variety of such products as lip treatments, facial powders and creams, eye shadow, eye liner, nail polish etc. Moreover, users of cosmetics frequently have an active lifestyle and partake of many activities during the day. Unfortunately, many cosmetic products can become smudged, worn away etc., over time during the day. As a result, there is a desire by many users to carry many of these products along with them during the day and re-apply them as needed. Many users carry these items in a purse, pocket book, back pack, satchel or other carrying device.

Although carrying devices such as purses come in a variety of sizes they all share one common feature. Frequently, no matter how large the purse or pocket book, it is never quite large enough or light enough for the active consumer. There always seems to be a need to add more items to the purse. Yet users are constrained by size and space limitations. Frequently, there is insufficient room for each of the items desired to be included by the consumer. Similarly, many of the cosmetic products come in large sizes that take up considerable volume in the carrying case.

One approach to solving the space issue is to provide smaller products i.e, travel or purse size cosmetic products such as mascara, perfume, powder, lip treatments, etc. that are small in size thus increasing the number of items that can be stored in a purse. While these petite items enhance the portability aspect of the product being packaged, there is a downside in that the quantity of product present in the package is reduced thus reducing the value to the consumer. Another problem with the smaller sized packages is the difficulty that the user has in finding the desired product in a reasonable period of time. in a large purse or pocketbook where there are a number of items both cosmetic and non cosmetic stored, the smaller size of the travel versions of the product have a tendency to become buried in the bottom of the purse thus rendering it difficult to locate the item.

Accordingly, there is a need for an improved cosmetic package for cosmetics that is capable of being stored in a purse handbag or other accouterment in as little space as possible.

OBJECTS OF THE INVENTION

It is an object of the present invention to provide a cosmetic container that occupies less space in a purse or bag.

It is an object of the present invention to provide a combination package for carrying two or more cosmetic products preferably different cosmetics products in a single package.

It is an object of the invention to provide a combination package for carrying two or more products and wherein there is at least one roll on applicator for applying a product.

It is an object of the invention to provide a combination package for carrying two or more products where the product contained in each portion of the combination package is the same product.

It is an object of the present invention to provide a roll on applicator in one portion of the device and a device for applying an eye product in the second portion of the device.

It is an object of the present invention to provide a roll on applicator containing a product containing a fragrance and a second roll on applicator containing an lip product in a single unitary package.

It is an object of the present invention to provide a roll on applicator for dispensing a product and device for applying a nail product in a single package.

It is an object of the present invention to provide dual container wherein the first portion of the container is a roll on applicator for applying a product containing a fragrance and the second portion of the container contains a nail product.

It is an object of the present invention to provide a roll on applicator for dispensing a product and a device for applying a facial product in a single package.

It is an object of the present invention to provide dual container wherein the first portion of the container is a roll on applicator for applying a product containing a fragrance and the second portion of the container contains a facial product.

It is an object of the present invention to provide a lip product that may be applied by a container having a rollerball type dispenser and a device for applying an eye product in a single package.

It is an object of the present invention to provide a lip product that is applied by a container having a rollerball type dispenser and a device for applying a facial product in a single package.

It is an object of the present invention to provide a lip product that is applied by a container having a rollerball type dispenser and a device for applying a nail product in a single package.

SUMMARY OF THE INVENTION

The present invention is for an improved cosmetic package that provides the user with two cosmetic materials in a single dual ended container. At least one of the containers preferably has an applicator that is in the form of a rollerball dispenser. In one embodiment, the present invention preferably provides a product that may be applied by a rollerball applicator in at least one end of such device. Typical products include liquids, semi liquids, materials of a pasty consistency and very fine powders. Preferably at least one end of the container has a rollerball applicator containing a product having a fragrance. The container typically has a pair of receptacles that are connected together by means of a center sleeve that is typically round in cross-section, although any cross-sectional shape is possible. The sleeve is preferably longer than its width of its cross section and the sleeve is preferably open at each end. The sleeve is provided with a means for connecting a receptacle containing preferably at least one rollerball applicator to the sleeve such as for example a threaded connection, a snap on fitting or a friction fit. The other receptacle can be a combination container and applicator for an eye shadow, a mascara, a nail polish, a powder etc.

DETAILED DESCRIPTION OF THE INVENTION

Figure 1:
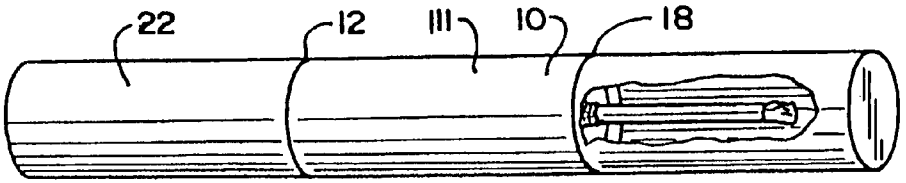
FIG. 1 shows a side view of the container of the present invention with a rollerball applicator in one end of the sleeve and container having a doe foot type applicator in the second end of the sleeve.
Figure 2:
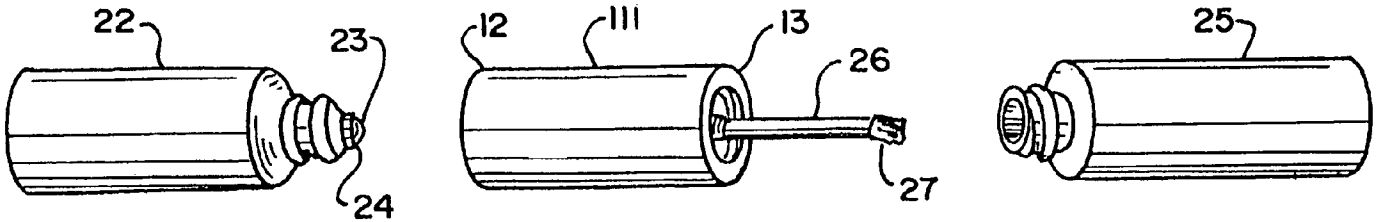
FIG. 2 shows the container of FIG. 1 with the components separated.

The dual cosmetic container 10 of the present invention has a central body or sleeve 11 (See FIG. 1A) that has a first end 12 and a second end 13 and which may be hollow throughout its entire length or at least have two portions thereof each for receiving and preferably retaining an end of a receptacle containing a products such as one of many different types of cosmetic type products. The sleeve 11 may have a cross-section or any shape, however, the cross-section will typically be round or square, elliptical or ovoid. In one embodiment, the sleeve may have two sections 14 and 15 which are connected by a sidewall 16. The first section 14 and the second section 15 are preferably opened and are preferably threaded on their interior surface so that they are adapted to receive a threaded end of a receptacle which contains a product. Alternatively, the first section 14 and the second section 15 may be adapted to receive and connect with the end of a receptacle that has any other type of connecting means such as a bayonet fitting or a snap fitting for retaining a receptacle in the sleeve. In some instances a friction fit may also be satisfactory. The receptacles may be held in place by any other means known to those skilled in the art.

Figure 1C:
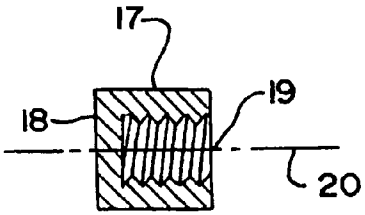
FIG. 1C is a side view of the cap for the sleeve of FIG. 1A.
Figure 1B:
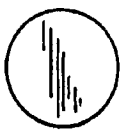
FIG. 1B is a view of the circular cross section of the sleeve of FIG. 1A taken along A-A.
Figure 1A:
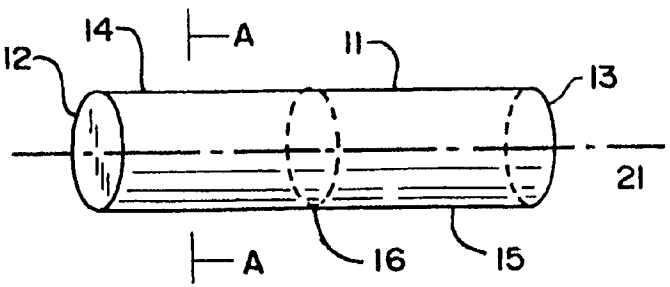
FIG. 1A is a side view of the sleeve of the container of FIG. 1

In one embodiment, the sections 14 and 15 may have a pair of conventional threaded caps, see FIG. 1C, inserted into the sleeve with the caps in a head to head relationship. The caps have a side wall 17, an end wall or head wall 18 and an open end 19, the interior of which may be threaded. When two caps are inserted into the sleeve, the end wall 18 of each are typically in contact with each other or the sidewall 16. The open ends of the sleeve 12 and 13 correspond to the open end of the caps 19. The body or sleeve 11 may be any length but it is preferably only of sufficient length to contain the pair threads or other receiving means for receiving a pair receptacles as well as the center wall, if present, that separates the products contained in each receptacle. The sleeve 11 may be made of any suitable material such as a metal or plastic, preferably a polished of matte metallic finish. Where caps are inserted into the sleeve, the central body 11 may also be any length but is preferably only of sufficient length to accommodate the caps at the first and second ends and the end walls of the caps. Where a pair of threaded caps are placed in a head to head relation in the sleeve preferably, the center axis 20 of each cap is preferably generally lined up with the other cap in a generally straight line, In addition, the center axis 21 of the sleeve and the center axis 20 of each of the caps preferably similarly line up in a generally straight line. Although depicted with the caps in an end to end relation one skilled in the art will appreciate that the ends need not be in a head to head position but rather, the heads may be off set.

Removably attached to each cap is a receptacle 22 for containing a product such as a cosmetic product. This receptacle may be of any shape. However, in a preferred embodiment the central body 11 is round in its cross section and the receptacles are also round and both the central body and the receptacles have diameters that are generally similar. In a more preferred embodiment the diameter of the receptacles and the diameter of the central body 11 are generally the same. In another preferred embodiment the cross-section of the receptacles and the cross-section of the central body are not round but are generally the same shape.

In one embodiment, at least one receptacle may be provided on its open end with a roller ball applicator 23 for applying product onto the user. In order to prevent essential oils and/or moisture from unnecessarily escaping from the receptacle the roller ball may have a spring 35 that seats the ball firmly in the rim 24 of the receptacle. The arrangement of the rollerball and spring are described in more detail in our U.S. Pat. No. 5,526,960, the disclosures of which are incorporated herein by reference. The rollerball of the present invention may be colored as described in more detail in our U.S. application Ser. No. 09/515,955 the disclosures of which are incorporated herein by reference.

In one embodiment, as shown in FIG. 1 one of the receptacles 22 is intended for a product containing a fragrance including but not limited to a perfume containing product and the other receptacle 25 is for an eye product, a lip product, or other product that may be applied by an applicator 111 with a doe foot 27. The doe foot 27 of the applicator 111 has a soft absorbent material at its end. Doe foot applicators are usually used for applying lip products, facial products eye products and others. The perfume product may be any product that contains a fragrance and can be a liquid, a semi-liquid or pasty consistency or a solid. The perfume product may be dispensed in any suitable fashion such as by a small orifice in the threaded end of the receptacle. Alternatively, the perfume may be dispensed by means of a spray applicator removably connected to the receptacle or a rollerball applicator as discussed above. The eye product may be a mascara, an eye liner, etc. In another embodiment the eye product may be dispensed by a rollerball arrangement in a receptacle similar to the receptacle 22 as described above, by an applicator 26 that extends from the cap into the receptacle or other suitable means. In one embodiment the applicator may be a doe foot applicator 27. Alternatively, instead of a doe foot applicator 27, a brush like a mascara brush can be used. Also, one or both ends of the applicator may have a cosmetic serum present and be applied by any of the applicator means described.

In another embodiment, the rollerball receptacle 22 may contain a liquid lip product, lip stain, lip gloss or other lip product. The other receptacle 25 may contain the same or a different type of lip product such as a clear or colored lip gloss, lip stain, liquid lip, etc., that may be applied with a doe foot applicator or another rollerball applicator. Similarly, the rollerball receptacle 22 may contain a clear lip gloss and the other receptacle 25 may contain a lip stain that may be applied with a doe foot applicator 27. In still another embodiment the rollerball applicator 25 may contain a facial product such as a blemish control material and the other receptacle 25 may contain the same or different facial product such as a concealer. In a further embodiment the rollerball applicator 25 may contain a facial product such as a concealer and the other receptacle 25 may contain the same or different facial product such as a blemish control material.

Figures 3, 4, 5, 6:
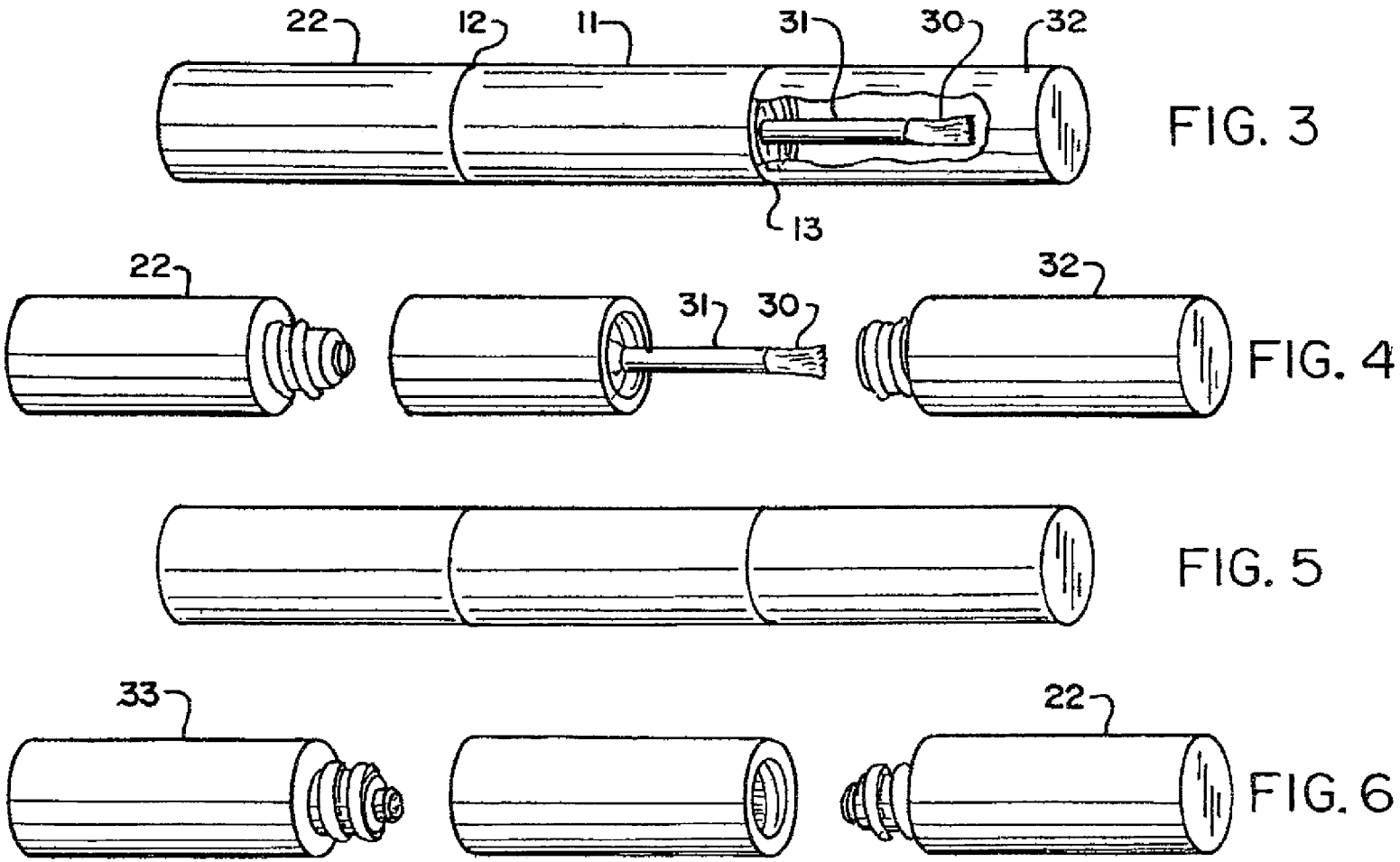
FIG. 3 shows a side view of the container of the present invention having a rollerball applicator in one end of the sleeve and a nail type brush extending from the second end of the sleeve into a container in a single package.
FIG. 4 shows the container of FIG. 5 with the components separated.
FIG. 5 shows a side view of the container of the present invention wherein the sleeve has a first rollerball in one end of the sleeve and a second rollerball in the second end of the sleeve.
FIG. 6 shows the container of FIG. 5 with the components separated.

FIG. 3 shows the container of the present invention is for a product that may be dispensed by a rollerball applicator as discussed above and an nail product in a single package. The receptacle 32 may contain a nail product. The nail product may be a nail polish or a hardener that is applied over a nail polish etc. The nail product may be dispensed by means of an applicator that is in the form of a brush 30 or other suitable means. The brush 30 may be attached to the inside of the cap by a shaft 31, generally located toward the center of the inside top surface of the cap in the sleeve. By the term cap is meant a cap as shown in FIG. 1C or the threaded interior of the sleeve where the side wall 16 constitutes the surface for appending the shaft.

In addition to the embodiments depicted in FIGS. 1-4, as shown in FIGS. 5 and 6 one receptacle 33 may be used for a facial product such as a powder, a cream, concealer, blemish control material, etc. The facial product may be dispensed by a number of means. In one embodiment, the facial product may be dispensed by means of a receptacle 33 having a rollerball arrangement as described above. In one embodiment, the rollerball arrangement may be provided with a spring as described above. The surface of the roller ball be smooth or slightly roughened depending on the consistency of the product to be dispensed. Alternatively, the facial product may be dispensed by means of a brush that is attached to the inside surface of the cap and which extends into the receptacle where it contacts a facial material such as blush, powder, cream etc.

Figure 7:
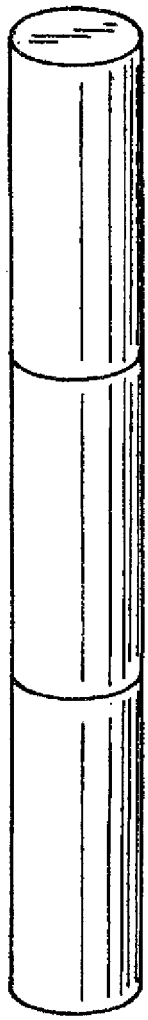
FIG. 7 shows a side view of the container of the present invention having a rollerball applicator for a facial product in one component and an eye product in a single package.
Figure 8:
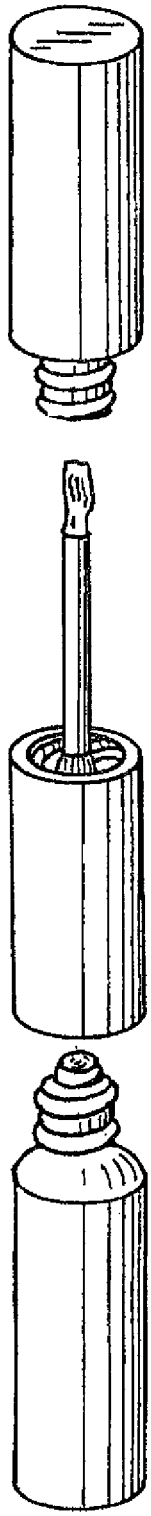
FIG. 8 shows the container of FIG. 7 with the components separated.
Figure 9:
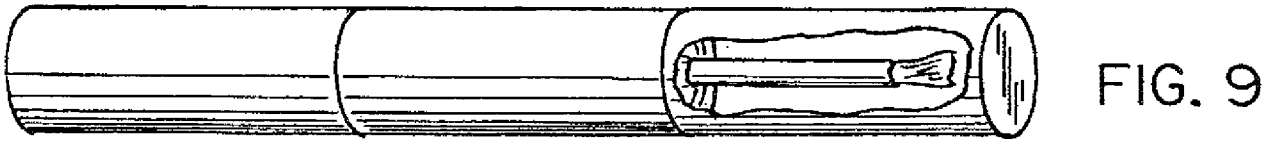
FIG. 9 shows a side view of the container of the present invention for a facial product and an nail product in a single package.
Figure 10:
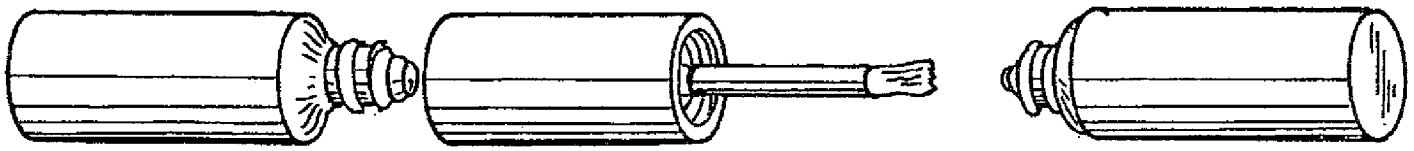
FIG. 10 shows the container of FIG. 9 with the components separated.

FIGS. 7 and 8 show a container of the present invention for a facial product and an eye product in a single package. FIGS. 9 and 10 show a container of the present invention for a facial product and a nail product in a single package.

Figure 11:
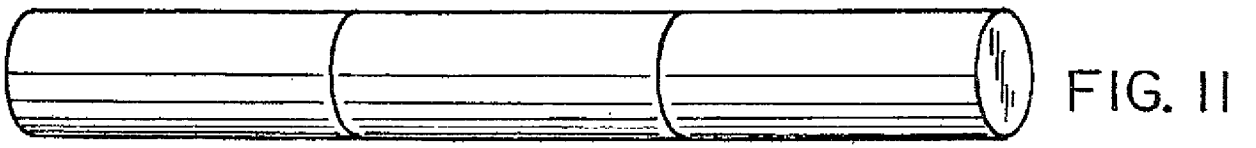
FIG. 11 shows a side view of the container of the present invention for a pair of facial products in a single package.
Figure 12:
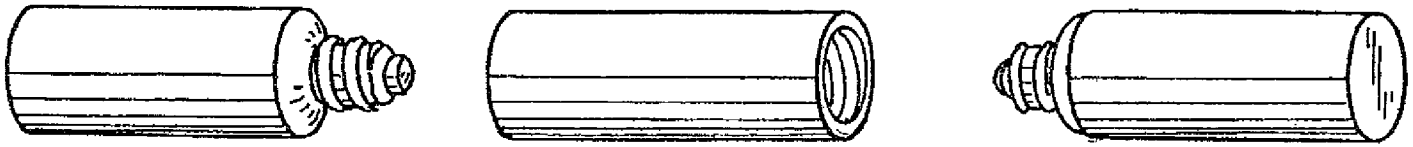
FIG. 12 shows the container of FIG. 11 with the components separated.
Figure 13:
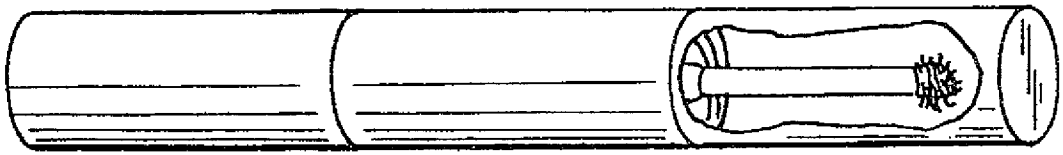
FIG. 13 shows the arrangement of the present invention where there is a rollerball applicator on one end of the sleeve and the other end of the sleeve has a mascara type brush extending from the cap in the sleeve.
Figure 14:
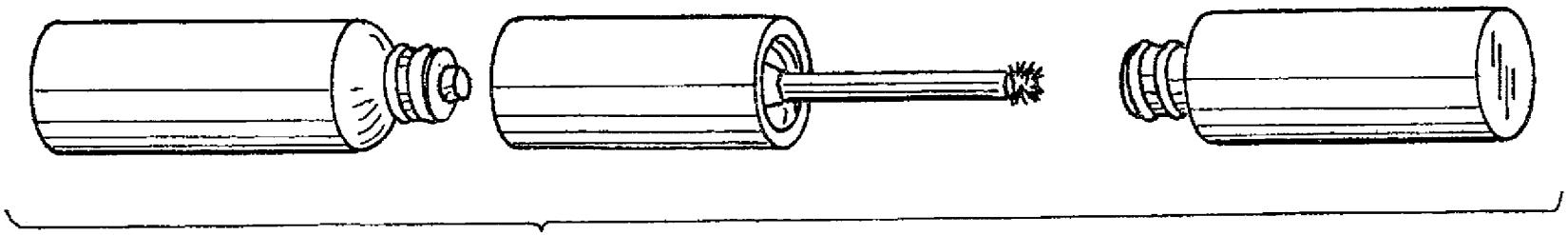
FIG. 14 shows the container of FIG. 13 with the components separated.
Figure 16:
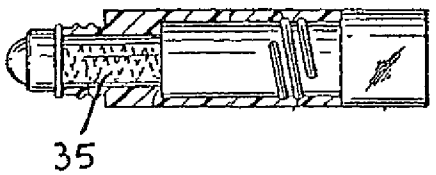
FIG. 16 (PRIOR ART)
FIG. 16 is a cross-sectional view of the container of FIG. 15.
Figure 17B:
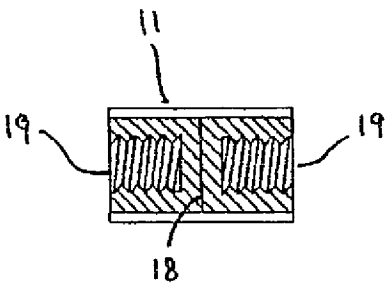
FIG. 17B is a cross-sectional view of the sleeve of FIG. 1A, and is shown with a pair of conventional threaded caps.
Figure 15:
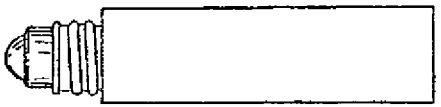
FIG. 15 is a side view of one of the containers of FIG. 2.
Figure 17A:
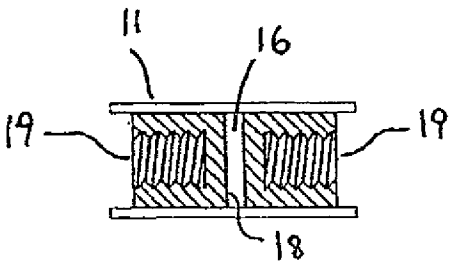
FIG. 17A is a cross-sectional view of the sleeve of FIG. 1A, and is shown with a dividing wall and a pair of conventional threaded caps.

FIGS. 9 and 10 show the container of the present invention where the receptacles have a pair of facial products in a single package. In one embodiment one receptacle may have a facial powder and the other a blush. Although depicted with a rollerball applicator, the applicator for the facial product may also be a brush. FIG. 11 shows a side view of the container of the present invention for a pair of facial products in a single package. FIG. 12 shows the container of FIG. 11 with the components containing the facial products being separated. FIGS. 13 and 14 show the arrangement of the present invention where there is a rollerball applicator on one end of the sleeve and the other end of the sleeve has a mascara type brush extending from the cap in the sleeve. The container may contain any product that may be applied by that type of brush such as mascara etc.

We claim:

1. A dual product cosmetics dispenser comprising:

a sleeve that has a first end and a second end, said sleeve having a generally constant circular cross section along the entire length of said sleeve, said sleeve being divided into a respective first section and a second section by a dividing wall, said dividing wall being located between said first end and said second end of said sleeve such that said first and second sections are generally the same length; a portion of each of said first and second ends of said sleeve comprising internal threading; said sleeve comprising a shaft protruding from said dividing wall into said second section of said sleeve with said shaft having a free end extending beyond said second end of said sleeve; said free end of said shaft comprising a brush applicator;

a first receptacle being adapted for containing a first product, said first receptacle having an open first end and a closed second end, said first receptacle comprising a body portion and a neck portion extending from said body portion, said neck portion having a diameter less than the diameter of said body portion, said neck portion comprising a portion therein with external threading that may be threadably received by said internal threading of said first end of said sleeve, said neck of said receptacle having a rim extending inward to thereby be configured to slidably retain a portion of a rollerball within said receptacle, with said rollerball being seated firmly against said rim by a spring configured to bias said rollerball, to thereby be configured to prevent escape of the one or more essential oils and/or moisture of said first product from said receptacle, until said rollerball rolls relative to said rim to dispense said first product, and said roller ball having a surface roughness calibrated to provide optimal delivery of said first product, said surface roughness of said roller ball being selected to be within a range of a smooth to a slightly rough surface roughness depending upon said first product's viscosity;

a second receptacle for containing a second product, said second receptacle having an open first end and a closed second end, said second receptacle comprising a body portion and a neck portion extending from said body portion, said neck portion having a diameter less than a diameter of said body portion, said neck portion comprising a portion therein with external threading that may be threadably received by said internal threading of said second end of said sleeve; said brush applicator on said shaft of said sleeve reaching at least part way to said end wall of said tubular body of said second receptacle when said second receptacle is threadably attached to said second section of said sleeve; and wherein said roller ball and said brush applicator on said shaft permit respective dispensing of said first and second products where each of said first second products are from the group of products consisting of: a liquid; a semi-liquid; and a solid.

2. The dual product cosmetics dispenser according to claim 1, wherein each of said first product and said second product is from the group of cosmetic products consisting of: a facial product; a lip product; a nail product; an eye product; a fragrance; and a cosmetic serum.

3. The dual product cosmetics dispenser according to claim 2, wherein said facial product comprises one or more of: a cream; a concealer; a blemish control material, and a powder.

4. The dual product cosmetics dispenser according to claim 3, wherein said fragrance comprises a perfume.

5. The dual product cosmetics dispenser according to claim 4, wherein said lip product comprises one or more of: a lip stain; and a lip gloss.

6. The dual product cosmetics dispenser according to claim 5, wherein said nail product comprises one or more of: a nail polish; and a hardener.

7. The dual product cosmetics dispenser according to claim 6, wherein said eye product is from the group of eye products consisting of eye liner; and mascara.

8. A combination cosmetics package for carrying and dispensing more than two products, said combination cosmetics package comprising:

a first receptacle and a first cosmetic product; said first receptacle being adapted for containing said first cosmetic product therein, said first receptacle comprising a body, a rollerball, and a spring; said body comprising a cylindrical body portion and a cylindrical neck portion, said body portion having a first end closed by an end wall, and a second end, said second end of said body portion transitioning into said neck portion, said neck portion extending away from said body portion and terminating at an open end, with a diameter of said cylindrical neck portion being less than a diameter of said body portion, said cylindrical neck portion comprising external threading, said open end of said neck portion comprising a rim extending inward and thereby configured to permit said rollerball to slidably seat thereon to selectively seal said open end of said neck portion, said rollerball being biased by said spring to normally seat firmly against said rim to thereby prevent escape of the one or more essential oils and/or moisture within said first cosmetic product from said opening, until said rollerball is slidably moved with respect to said rim to receive said first product onto a portion of said seated rollerball and out of said opening, to dispense said first cosmetic product; and said rollerball having a surface roughness calibrated to optimally dispense said first cosmetic product, said surface roughness of said rollerball being selected to be within a range of a smooth to a slightly rough surface roughness depending upon said first product's viscosity;

a second receptacle and a second cosmetic product; said second receptacle constructed the same as said first receptacle, except with said second cosmetic product therein and with said rollerball of said second receptacle having a surface roughness calibrated to optimally dispense said second cosmetic product, with said surface roughness of said rollerball of said second receptacle being selected to be within a range of a smooth to a slightly rough surface roughness depending upon said second product's viscosity; said second cosmetic product having a different viscosity than said first cosmetic product, and said rollerball of said second receptacle having a different surface roughness than said rollerball of said first receptacle;

a third receptacle and a third cosmetic product; said third receptacle comprising a cylindrical body portion and a cylindrical neck portion, said body portion having a first end closed by an end wall, and a second end, said second end of said body portion transitioning into said neck portion, said neck portion extending away from said body portion and terminating at an open end, with a diameter of said cylindrical neck portion being less than a diameter of said body portion, said cylindrical neck portion comprising external threading;

a fourth receptacle and a fourth cosmetic product; said fourth receptacle constructed the same as said third receptacle, except with said fourth cosmetic product contained therein;

a first sleeve, said first sleeve having a first end and a second end, said first sleeve comprising a hollow cylinder with a dividing wall therein to divide said cylinder into a first cylindrical section and a second cylindrical section; said sleeve comprising a shaft protruding from said dividing wall, and extending to be generally concentric with said second cylindrical section of said sleeve, with said shaft having a free end extending beyond said second end of said sleeve; said free end of said shaft comprising a brush applicator; each of said first and second cylindrical sections of said sleeve comprising internal threading, said internal threading of said first cylindrical section of said first sleeve configured to releasably receive said external threading of either of said first or said second receptacles; and said internal threading of said second cylindrical section configured to releasably receive said external threading of either of said third or said fourth receptacles, with said brush applicator on said shaft of said first sleeve configured to reach at least part way to said end wall of said body portion of said third or fourth receptacle when threadably received thereon;

a second sleeve; said second sleeve constructed the same as said first sleeve, said internal threading of said first cylindrical section of said second sleeve configured to releasably receive said external threading of the other of said first or second receptacles not currently being releasably received by said first cylindrical section of said first sleeve; and said internal threading of said second cylindrical section of said second sleeve configured to releasably receive said external threading of the other of said third or said fourth receptacles not currently being releasably received by said second section of said first sleeve, with said brush applicator on said shaft of said second sleeve configured to reach at least part way to said end wall of said body portion of said third or fourth receptacle when threadably received thereon;

wherein said rollerball of each of said first and second receptacles permit respective dispensing of said first cosmetic product and said second cosmetic product, where each of said first and second cosmetic products are from the group of products consisting of: a liquid; a semi-liquid; and a solid; and wherein said brush applicator on said shaft of said second cylindrical section of each of said first and second sleeves permit respective dispensing of said third cosmetic product and said fourth cosmetic product, where each of said third and fourth cosmetic products are from the group of cosmetic products consisting of: a liquid; a semi-liquid; and a solid.

9. The combination cosmetics package according to claim 8, wherein each of said first cosmetic product, said second cosmetic product, said third cosmetic product, and said fourth cosmetic product are from the group of cosmetic products consisting of: a facial product; a lip product; a nail product; an eye product; a fragrance; and a cosmetic serum.

10. The combination cosmetics package according to claim 9, wherein said facial product comprises one or more of: a cream; a concealer; a blemish control material, and a powder.

11. The combination cosmetics package according to claim 9, wherein said fragrance comprises a liquid perfume.

12. The combination cosmetics package according to claim 9, wherein said lip product comprises one or more of: a lip stain; and a lip gloss.

13. The combination cosmetics package according to claim 9, wherein said nail product comprises one or more of: a nail polish; and a hardener.

14. The combination cosmetics package according to claim 9, wherein said eye product is from the group of eye products consisting of: eye liner; and mascara.

* * * * *